United States Patent [19]

Seytre et al.

[11] 4,350,403

[45] Sep. 21, 1982

[54] CONNECTING-STRIP FOR PLUG-IN CARDS AND A CONNECTOR FITTED WITH CONNECTING-STRIPS OF THIS TYPE

[75] Inventors: Bruno Seytre; Hervé Bricaud, both of Suresnes, France

[73] Assignee: Socapex, Suresnes, France

[21] Appl. No.: 138,449

[22] Filed: Apr. 8, 1980

[30] Foreign Application Priority Data

Feb. 7, 1980 [FR] France ..... 80 02676

[51] Int. Cl.[3] ..... H01R 13/62

[52] U.S. Cl. ..... 339/91 R

[58] Field of Search ..... 339/75 R, 75 M, 75 MP, 339/91 R

[56] References Cited

U.S. PATENT DOCUMENTS 4,023,878 5/1977 Hennessey .
4,072,387 2/1978 Sochor .
4,130,327 12/1978 Spaulding ..... 339/75 M X

FOREIGN PATENT DOCUMENTS 2204941 5/1974 France .
1074412 7/1967 United Kingdom .
1366928 9/1974 United Kingdom ..... 339/75 MP

*Primary Examiner*—Joseph H. McGlynn
*Assistant Examiner*—Frank H. McKenzie, Jr.
*Attorney, Agent, or Firm*—Cushman, Darby & Cushman

[57] ABSTRACT

A connector for plug-in card circuits is provided with at least one connecting-strip constituted by a parallelepipedal base and cover-plate for supporting a plurality of resilient electrical contact elements. The cover-plate is capable of pivotal displacement with respect to the base for inserting the edge of a card in the open position and establishing an electrical contact between the conductive elements of the strip and of the card in the closed position. Deformation of the strip in the closed position is prevented by a clip in the form of a U-section member having a resilient central portion, the two arms of which are applied respectively on the base of the connecting-strip and on the cover-plate.

15 Claims, 6 Drawing Figures

FIG. 5
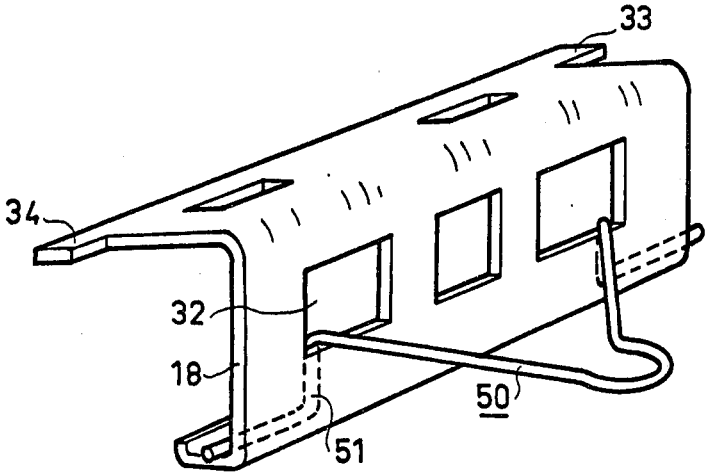
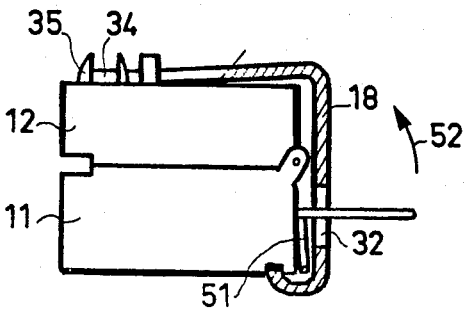
FIG. 6a
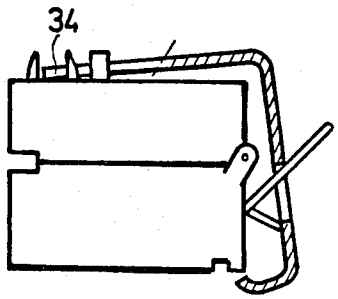
FIG. 6b

CONNECTING-STRIP FOR PLUG-IN CARDS AND A CONNECTOR FITTED WITH CONNECTING-STRIPS OF THIS TYPE

This invention relates to the field of card-edge connectors for plug-in board circuits.

A plug-in board (designated hereinafter as a card) has the appearance of a small plate having the shape of a quadrilateral and formed of electrically insulating material. The card is designed to support a plurality of electronic components and interconnecting leads, such leads being formed in the majority of instances by depositing a metal having good electrical conductivity on the card.

Connection with external utilization circuits is effected by means of a plurality of contacts placed on one or a number of sides of the card and adapted to cooperate with contacts of complementary shape forming part of a fixed connector which is connected to the utilization circuits. As a general rule, said connector performs a second function, namely that of serving as a mechanical support for the card in the equipment in which it is employed.

By virtue of the fact that the plug-in card has the shape of a quadrilateral, the connectors are thus endowed with the general structure of elongated blocks in the form of strips which are sometimes placed at right angles on a common flat base.

In one form of construction which is frequently encountered, and in particular when provision is made for four connecting-strips defining a closed quadrilateral, positioning of a plug-in card for connection and fixing calls for the construction of connecting-strips in two portions which are capable of relative displacement with respect to each other. This entails the need to initiate an operation in two stages: a card insertion stage corresponding to an open position of the movable portion followed by a card connecting and fixing stage corresponding to the closed position of said movable portion.

In some cases, these arrangements provide the possibility of placing a card in position by means of a simple movement of translation in a direction parallel to a connecting-strip such that the open position produces a withdrawal of the electric contacts and ensures frictionless insertion of the card.

A strip element which forms part of a connector of this type is constructed in most cases in two main portions formed of insulating material, namely a fixed base and a cover-plate which are fitted with rows of conductive contact elements and pivotally coupled by means of a longitudinal pin for producing the aforementioned open and closed positions of the connector.

However, the closed position has the effect of applying the contacts of the connector against the connecting-strips with a force which is determined by the elastic material chosen for the contacts and which is essential in order to ensure that the contacts have low electrical resistance.

In order to compensate for the resultant oppositely-acting elastic force, screw-tightening means are usually provided between the base and the cover-plate and placed either at the ends of these if the connecting-strip is of small length or at intervals along the strip if this latter is of substantial length. By ensuring in addition that the base and the cover-plate have an appreciable thickness and are thus endowed with a high degree of longitudinal strength and rigidity, deformation between two successive screws accordingly remains tolerable and does not modify the value of electrical contact resistance to any appreciable extent.

It is an entirely different matter when connectors of smaller size are required by reason of the current trend towards greater miniaturization. In the first place, it is becoming an increasingly common practice to superpose a plurality of card circuits arranged in tiers. The need for reduction of overall size makes it necessary to provide a small vertical space between two connecting-strips, with the result that a screwdriver can be introduced only with difficulty.

A further trend in current practice is to reduce the thicknesses of connecting-strips. Since the bearing pressures imposed by the need to provide good electrical contacts remain the same, it accordingly becomes necessary to reduce the spacing between the screws employed for clamping the cover-plate to the base and consequently to increase the number of screws required. The distance between screws cannot be reduced beyond a certain limit, however, since each screw takes up a space which would otherwise be occupied by a number of useful contact elements. In practice, the cover-plates also tend to move away from the bases between two successive screws and assume the shape of arcs along which the contacts exhibit substantial variations in resistance as a function of their positions on these latter.

Moreover, the disadvantage of a screw-type assembly lies in the increasing length of time required for screw-tightening and slackening operations.

It should finally be pointed out that, in order to ensure minimal resistance at the mid-point of each arc, it is necessary to exert at said mid-point a sufficiently high pressure which becomes excessive in the vicinity of each screw, thus giving rise to a potential danger of impairment of contacts or of card failure in the case of delicate circuits such as those formed on ceramic plates, for example.

The connector according to the present invention is not attended by any of the drawbacks mentioned in the foregoing.

The connector provides electrical contacts having a low and substantially constant resistance between connector and card circuit; it permits the use of connecting-strips having substantial lengths while entirely dispensing with the need for clamping screws; another noteworthy feature is that the connector can readily be employed in miniaturized equipment since the means for clamping the cover-plates on the bases are of negligible thickness. Finally, connecting and disconnecting operations corresponding to closing and opening stages are practically instantaneous.

The design concept of the invention lies in the fact that the respective functions of supporting of contact elements and application of bearing pressures which were assumed in connectors of the prior art are made separate and distinct in the case of the base and cover-plate according to the invention. Whereas the supporting function is retained, different means are adopted for pressure application which is produced by elasticity and transmitted solely by the cover-plate, such means being endowed with high longitudinal strength and rigidity.

The general configuration of the pressure-application means under consideration is that of an L-section member or alternatively a U-section or horseshoe-section member having well-known characteristics of high longitudinal rigidity, the portion which is endowed with elasticity being the base of the sectional member in which the two arms of the horseshoe are joined together.

In more exact terms, the invention consists of a plug-in card connecting-strip constituted by a parallelepipedal base and cover-plate which support a plurality of electrical contact elements endowed with elasticity. The cover-plate is capable of pivotal displacement about a longitudinal axis parallel to the base so as to take up two positions respectively of opening for inserting the edge of a card and of closure for placing the respective conductive elements of the connecting-strip and of the card in contact with each other. The closing action aforesaid is produced by a clip in the form of a U-section member arranged parallel to the longitudinal axis of the strip. The two arms of the clip are applied respectively on two zones of the base and of the cover-plate, thus ensuring closure by application of a force produced by elastic deformation of the base portion which provides a connection between the two arms.

These and other features of the invention will become more apparent upon consideration of the following description and accompanying drawings, wherein:

FIGS. 5 and 6 illustrate a clip-opening device which forms part of the invention.

Figure 1:
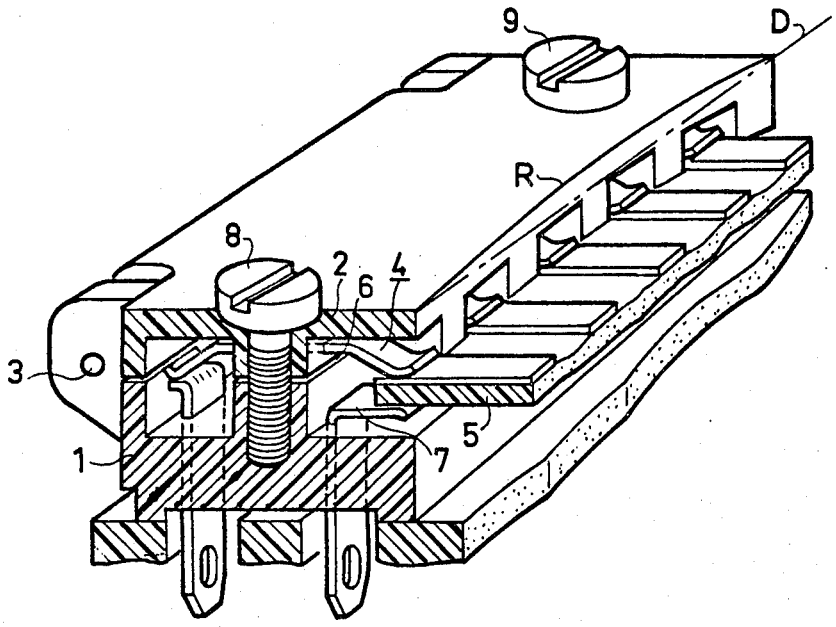
FIG. 1 PRIOR ART
FIG. 1 is a part-sectional view in perspective showing a connecting-strip in accordance with the prior art.

A plug-in card connector in accordance with the known art is shown in the part-sectional view in perspective of FIG. 1.

This connector is composed of a base 1 and a cover-plate 2 which are capable of pivotal displacement with respect to each other about the pivot-pin 3, and a plurality of contact elements such as the element 4. The card 5 is inserted in the open position of the connector which has been subjected to pivotal displacement about the pin 3. The closed position has the effect of compressing the resilient portions 6 and 7 of the contacts and the reaction of these latter exerts a force F which tends to move the cover-plate away from the base. In order to oppose this force, provision is made for a plurality of screws such as the screws 8 and 9.

However, as explained in the foregoing, the cover-plate region located between two successive screws is not applied against the base in a positive manner. As a result of deformability of the insulating material, the apparent straight contour line D is replaced by a curved contour R. This gives rise to all the disadvantages explained earlier in regard to high and irregular contact resistance in addition to the loss of available space for contacts opposite to each screw-clamping region.

Furthermore, in the case of tiered-card units, the spatial interval between two superposed connecting-strips must be left free over a vertical distance at least equal to the length of a screw in order to permit opening of the connector. This restrictive condition is contrary to the increasing requirements of miniaturization of equipment.

Figure 2:
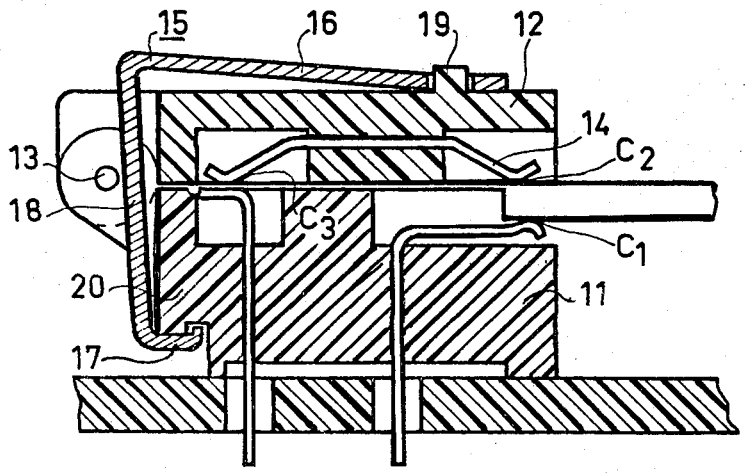
FIG. 2 is a sectional view of a connecting-strip according to the invention.

FIG. 2 is a sectional view showing a connecting-strip according to the invention for plug-in cards.

Said connecting-strip comprises a base 11, a cover-plate 12 which permits of pivotal displacement about the pin 13 and a plurality of contacts such as the contact 14.

The closed position is ensured by separate means consisting of a sectional member 15 having a U-section or "horseshoe" section in which two unequal arms 16 and 17 are joined together by an intermediate portion 18 or junction base. Said sectional member is fabricated from resilient material such as stainless steel and will be designated hereinafter as a clip. This clip assumes two functions, namely on the one hand the application of a strip-closing force acting in opposition to the resilient forces which tend to open this latter and are developed by the contacts and, on the other hand, a function which arises from the characteristic of longitudinal rigidity of the U-section members and consists in maintaining the longitudinal linear shape of the cover-plate for which the clip is substituted from the standpoint of undeformability.

The clip is fixed in position by means of projecting portions 19 and 20 carried by the connecting-strip and adapted to cooperate with regions of complementary shape carried by said clip.

Figure 3:
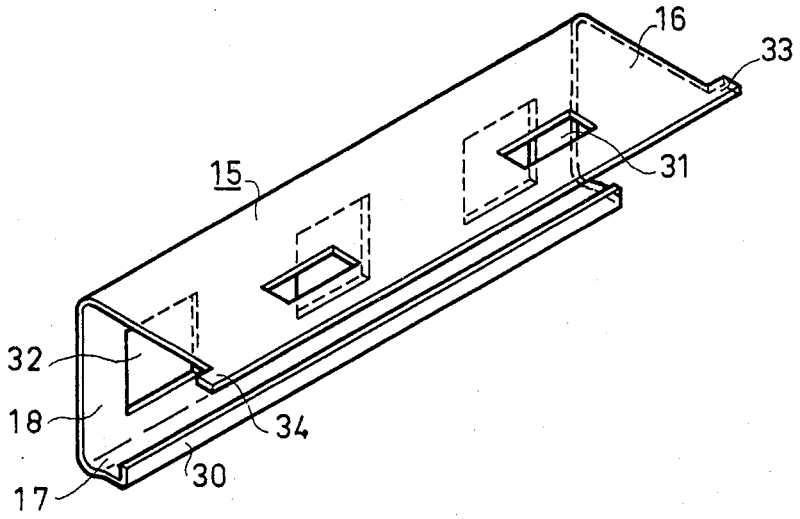
FIG. 3 is a view in perspective showing a closure clip for a connecting-strip according to the invention.

FIG. 3 is a perspective view showing a closure clip according to the invention. Said clip is designed in the form of a U-section member having unequal arms 16 and 17. The curved arm 17 is provided with a bead 30 for fixing this latter within a recess carried by the base of the connecting-strip. The long arm 16 is provided with openings such as the opening 31 which are intended to cooperate with lugs 19 carried by the cover-plate and shown in FIG. 2.

Openings 32 are arranged in the arm-connecting portion or junction base 18. By adopting suitable dimensions of said openings, these latter are intended to permit accurate adjustment of elasticity of the clip. Said openings can have another function at the time of opening of the connecting-strip as will be explained hereinafter.

Finally, the clip is provided at the ends of the long arm 16 with two longitudinal lugs 33 and 34 which are capable of penetrating into open recesses formed in the top portion of the cover-plate, thus constituting pivotal-motion bearings for coupling the clip and the cover-plate in the open position.

Figure 4:
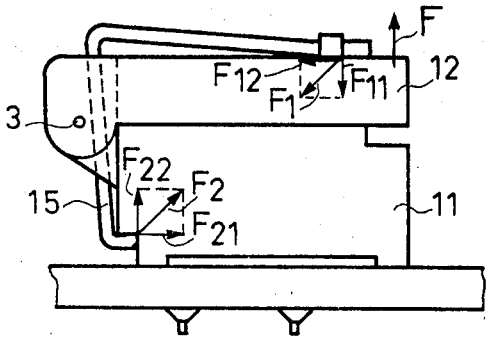
FIG. 4 is an explanatory diagram relating to the operation of the connector according to the invention.

The schematic sectional view of FIG. 4 provides an explanatory diagram of operation of the connecting-strip.

The clip 15 mounted on the connecting-strip exerts two equal and opposite forces F1 and F2 on said strip. The force F exerted by the contacts on the two portions tends to open the strip.

Resolution of the forces applied in two perpendicular directions, one of which is parallel to F, results in horizontal components F12 and F21 which are balanced by virtue of the pivotal axis 3, and a component F11 having the same direction as F and of opposite sense.

The advantageous result of the invention lies in the fact that $F11 < F$ throughout the length of the connecting-strip without any need to ensure perfect rigidity of the cover-plate as explained in detail in the foregoing. Thus said cover-plate can be fabricated from deformable plastic material having a small thickness with respect to the overall length.

FIGS. 5 and 6 illustrate a clip-opening device which forms part of the present invention. Opening can be obtained by withdrawal of the short arm from its recess by means of any suitable tool inserted between the junction base 18 of the clip and the base of the connecting-strip 11. However, a particularly advantageous means is constituted by an elbowed lever 50, the elbowed portion 51 of which can be inserted in one of the openings 32 of the junction base according to position (a) of FIG. 6. By rotating the lever 50 in the direction of the arrow 52, the elbowed portion 51 is applied simultaneously against the connector base and the junction base of the clip, thus producing withdrawal of said clip and pivotal displacement of this latter about the bearing elements 34 within the open recesses 35 carried by the top face of the cover-plate 12.

The invention thus offers the possibility of forming superposed arrays of tiered plug-in cards spaced at very small intervals since the closing clip which forms part of the connecting-strip according to the invention is of very small thickness and does not entail the need for any additional space for strip-positioning and withdrawal operations which have the further advantage of being practically instantaneous.

The results obtained in the field of electrical contact resistances both in absolute value and in regularity are also highly advantageous in comparison with those obtained in the case of connecting-strips of the prior art as clearly shown by the comparative tables given below, in which Table A corresponds to the results of the prior art and Table B corresponds to the improved results obtained by means of the connecting-strip according to the invention.

TABLE A

| Contacts | $C_1$ | $C_2 + C_3$ |
|---|---|---|
| $R_c$ mean (m Ω) | 24 | 37 |
| $R_c$ minimum (m Ω) | 21 | 33 |
| $R_c$ maximum (m Ω) | 28 | 41 |

TABLE B

| Contacts | $C_1$ | $C_2 + C_3$ |
|---|---|---|
| $R_c$ mean (m Ω) | 9 | 11 |
| $R_c$ minimum (m Ω) | 8 | 9.5 |
| $R_c$ maximum (m Ω) | 10 | 12 |

What is claimed is:

1. A plug-in card connecting strip, comprising:

a parallelepiped base and a cover plate supporting a plurality of electrical contact elements endowed with elasticity, the cover-plate being capable of pivotal displacement about a longitudinal axis parallel to the base into either an open or closed position, the open position being for inserting the edge of a card and the closed position being for placing the respective conductive elements of the connecting strip and of the card in contact with each other, the closing action being produced by a clip having a generally U-shaped section including an intermediate portion and two arms, the clip being positioned parallel to the longitudinal axis of the strip with the two arms thereof being applied to respective zones of the base and cover-plate so that the clip deforms, thus ensuring closure by application of a force produced by elastic deformed clip, the arm of the clip which is applied against the cover plate being provided substantially at the ends thereof with bearing elements capable of pivoting within corresponding recesses in the cover plate.

2. A connecting strip according to claim 1 wherein the bearing elements comprise pivot pins.

3. A connecting strip according to claim 1 or 2 wherein the intermediate portion of the clip has an opening therein.

4. A connecting strip according to claim 3 further including an elbowed lever having a lever arm positioned through the opening and an elbow portion positioned between the base and the intermediate portion of the clip, whereby an opening of the connecting strip is effected by the rotational displacement of the lever arm about a direction parallel to the longitudinal axis of the connecting strip.

5. A plug-in card connector comprising a plurality of strips according to claim 1 or 2.

6. A plug-in card connector comprising a plurality of strips according to claim 3.

7. A plug-in card connector comprising a plurality of strips according to claim 4.

8. A connecting strip for plug-in card having electrical contact elements comprising:

a generally parallelepiped base member;

a cover plate member;

a plurality of electrical contact elements endowed with elasticity supported by the base and cover plate members, the cover-plate member being capable of pivotal displacement about a longitudinal axis parallel to the base into either an open or closed position, the open position being for inserting the edge of a card and the closed position being for placing the respective conductive elements of the connecting strip and of the card in contact with each other, the cover plate member including two projections on an upper surface thereof; and a clip for producing a closing action of the base and cover plate members, the clip being formed in a generally U-shaped section including an intermediate portion and two arms of unequal length, the clip being positioned parallel to the longitudinal axis of the strip with the two arms thereof being applied to respective zones of the base and cover-plate so that the clip deforms, thus ensuring closure by application of a force produced by the deformed clip, the clip further including two openings cooperating with the projections on the upper surface of the cover plate.

9. A connecting strip according to claim 8 further comprising bearing elements formed substantially at ends of the arm in contact with the cover plate member for pivoting the clip within corresponding recesses formed in the cover plate.

10. A connecting strip according to claim 9 wherein the bearing elements comprise pivot pins.

11. A connecting strip according to claim 8, 9 or 10 wherein the intermediate portion of the clip has an opening therein.

12. A connecting strip according to claim 11 further including an elbowed lever having a lever arm positioned through the opening and an elbow portion positioned between the base and the intermediate portion of the clip, whereby an opening of the connecting strip is effected by the rotational displacement of the lever arm about a direction parallel to the longitudinal axis of the connecting strip.

13. A plug-in card connector comprising a plurality of strips according to claim 8, 9 or 10.

14. A plug-in card connector comprising a plurality of strips according to claim 11.

15. A plug-in card connector comprising a plurality of strips according to claim 12.

* * * * *